US006521584B1

(12) United States Patent
Soldanski et al.

(10) Patent No.: US 6,521,584 B1
(45) Date of Patent: Feb. 18, 2003

(54) LIQUID MULTIPHASE DETERGENTS

(75) Inventors: Heinz-Dieter Soldanski, Essen (DE); Juergen Noglich, Duesseldorf (DE); Alexander Ditze, Duesseldorf (DE); Marc Benoit, Versailles (FR)

(73) Assignee: Henkel Kommanditgesellschaft auf Aktien, Dusesseldorf (DE)

( * ) Notice: Subject to any disclaimer, the term of this patent is extended or adjusted under 35 U.S.C. 154(b) by 0 days.

(21) Appl. No.: 09/646,432

(22) PCT Filed: Mar. 9, 1999

(86) PCT No.: PCT/EP99/01506

§ 371 (c)(1),
(2), (4) Date: Feb. 12, 2001

(87) PCT Pub. No.: WO99/47634

PCT Pub. Date: Sep. 23, 1999

(30) Foreign Application Priority Data

Mar. 16, 1998 (DE) ..... 198 11 387

(51) Int. Cl.[7] ..... C11D 3/18

(52) U.S. Cl. ..... 510/417; 510/180; 510/181; 510/238; 510/241; 510/242; 510/243; 510/365; 510/484

(58) Field of Search ..... 510/417, 484, 510/365, 180, 181, 238, 241, 242, 243, 244

(56) References Cited

U.S. PATENT DOCUMENTS

| | | | | |
|---|---|---|---|---|
| 3,718,609 A | 2/1973 | Weimer | ..... | 252/545 |
| 3,839,234 A | 10/1974 | Roscoe | ..... | 252/544 |
| 3,882,038 A | 5/1975 | Clayton et al. | ..... | 252/164 |

FOREIGN PATENT DOCUMENTS

| | | |
|---|---|---|
| CA | 951 213 | 7/1974 |
| CA | 1 334 173 | 1/1995 |
| DE | 22 20 540 | 11/1973 |
| DE | 39 10 170 | 10/1989 |
| EP | 0 195 336 | 8/1989 |
| EP | 0 344 847 | 12/1989 |
| EP | 0 393 772 | 10/1990 |
| EP | 0 723 005 | 7/1996 |
| FR | 2 101 710 | 3/1972 |
| GB | 1 133 870 | 11/1968 |
| GB | 2 173 508 | 10/1986 |
| WO | WO97/38076 | 10/1997 |

*Primary Examiner*—Gregory E. Webb
(74) *Attorney, Agent, or Firm*—Stephen D. Harper; Glenn E. J. Murphy; Daniel S. Ortiz

(57) ABSTRACT

The invention relates to liquid multiphase, essentially CFC-free detergents with at least two continuous phases. The detergents have at least one aqueous phase (I) and a non-aqueous liquid phase (II) that is immiscible with phase (I), and can be temporarily transformed into an emulsion by shaking. They also contain an anionic and/or non-ionic surfactant and are suitable for use in a method for cleaning hard surfaces, especially glass. According to said method, the inventive detergent is shaken to produce the temporary emulsion and applied to the surface to be cleaned in quantities of 1.5 to 10 g per m^2, preferably by spraying. The surface is then cleaned, optionally by wiping with a soft, absorbent object.

20 Claims, No Drawings

LIQUID MULTIPHASE DETERGENTS

FIELD OF THE INVENTION

The invention relates to multiphase liquid, essentially chlorofluorocarbon (CFC)-free detergent, which can be temporarily transformed into an emulsion by shaking and which are suitable for cleaning hard surfaces, especially glass, and a method for cleaning hard surfaces.

BACKGROUND OF THE INVENTION

The detergents currently used for hard surfaces are generally aqueous preparations in the form of a stable solution or dispersion, whose essential active constituents are surface-active substances, organic solvents and possibly chelating agents for the hardness constituents of the water, abrasive substances and cleansing alkalis. Detergents which are intended especially for cleaning glass and ceramic surfaces are frequently formulated as solutions of the active constituents in a mixture of water and organic solvents miscible with water, primarily low alcohols and glycol ethers. Examples of such detergents are to be found in the German disclosure document 22 50 540, the U.S. Pat. Nos. 3,839,234 and 3,882,038 and in the European patent applications 344 847 and 393 772.

During use of the detergents, besides the requirement for high cleaning efficiency, there is also the requirement for utilization of the detergents to be as simple and convenient as possible. For the most part it is expected that the detergent will deliver the desired effect with a single application without further measures. In the case of use on smooth surfaces in particular, especially those, such as glass or ceramics, which can reflect like a mirror, difficulties arise because detergents that clean well do not usually dry streak-free, whilst detergents that essentially dry without visible residues have only a limited cleaning effect. To achieve sufficient cleaning effect with acceptable residue behavior, especially with regard to greasy marks, it is necessary to add fairly large quantities of more or less volatile alkalis, as well as organic solvents, to the detergents,. Ammonia and alkanolamines have proved especially suitable for this purpose. Fairly high concentrations of ammonia and/or amine however, besides having a noticeable unpleasant smell, correspondingly increase the pH value of the detergent solution, with the result that more sensitive areas, such as lacquered surfaces, are clearly attacked by these detergents. The requirement thus still remains for detergents that, with high cleaning efficiency, do not have the abovementioned disadvantages.

The German disclosure document 39 10 170 describes compounds used as mouthwash for bacterial desorption of solid surfaces and living tissues. These compounds exist in the form of a 2-phase preparation, and when shaken form a temporary oil-in-water emulsion of limited duration, with the aqueous phase comprising c. 50–97 wt. %, and the oil phase, which is not miscible with water, c. 3–50 wt. %. An essential feature of the invention is a content of c. 0.003–2 wt. % of an amphiphilic cationic agent, for example a cationic tenside, in a quantity enabling the formation of the oil-in-water emulsion, with this emulsion breaking down and separating after c. 10 seconds–30 minutes after its formation. Anionic tensides impair the antibacterial effect. Other tensides are not mentioned.

The European patent application 0 195 336 describes in two embodiments (1) and (2), care products that can be emulsified by shaking, for sensitive surfaces, especially (1) plastic surfaces or (2) compact discs. Besides an aqueous phase, these products also contain an organic phase consisting of the CFC 1,1,2-trichloro-1,2,2-trifluoroethane. Furthermore, the products are free of wax and contain in the aqueous phase (1) at least one tenside and a water-soluble liquid silicon oil, or (2) the triethanolamine salt of a $C_{10-12}$-alkyl sulfuric acid semi-ester. Nothing is said about the stability of the emulsion generated by shaking. To guarantee emulsifiability the tenside content is normally 1–10 wt. %, especially 2–8 wt. %, but if necessary also over 10 wt. %, with anionic tensides, especially those with a sulfate or sulfonate group, being preferred. Because of their environmentally damaging properties, especially in connection with the hole in the ozone layer, the use of CFCs should however be reduced or, better still, avoided.

BRIEF DESCRIPTION OF THE INVENTION

The task of the present invention was therefore to provide high-efficiency, essentially CFC-free agents that are stable in storage and easy to handle, for cleaning hard surfaces; said agents to have separate phases, to be able to be emulsified for application, to remain homogenous during application and subsequently to form separate phases again.

The object of the invention is, in a first embodiment, a liquid, multiphase, essentially CFC-free detergent with at least two continuous phases, including at least one aqueous Phase I, and a non-aqueous liquid Phase II with is not miscible with this aqueous phase. Said detergent can be temporarily transformed into an emulsion by shaking, and contains the anionic and/or non-ionic tenside.

In the simplest case an agent according to the invention consists of a continuous aqueous phase, which consists of the whole of Phase I, and a continuous non-aqueous liquid phase, that consists of the whole of Phase II. One or more continuous phases of an agent according to the invention can however also contain parts of another phase in emulsified form, so that in such an agent, for example Phase I is present partly as continuous Phase I, representing the continuous aqueous phase of the agent, and is partly emulsified as discontinuous Phase I in the continuous non-aqueous Phase II. The same applies to Phase II and further continuous phases.

DETAILED DESCRIPTION OF THE INVENTION

Non-miscible, non-aqueous phase means, in the context of the present invention, phase not based on water as solvent, although small quantities, relative to Phase II, of water, of up to 10 wt. %, but usually not more than 5 wt. %, can be contained, completely dissolved, in the non-aqueous Phase II. Furthermore, the term essentially CFC-free in this connection shall be taken to mean that the non-aqueous liquid Phase II is not based on CFC. However the agents according to the invention preferably contain no CFCs, because of the negative environmental effects of these compounds, although small quantities relative to the agent as a whole, of up to c. 5 wt. % can still be tolerated.

The object of the invention is furthermore a method for cleaning hard surfaces, especially glass, in which a detergent according to the invention is temporarily transformed into an emulsion by shaking, applied to the surface to be cleaned in quantities of 1.5–10 g per $m^2$, preferably by spraying, and this surface is then cleaned, optionally by wiping with a soft, absorbent object.

In addition to their high cleaning efficiency, the agents according to the invention are especially stable in storage.

Thus the individual phases in the agent are stable over a long period, without, for example, deposits forming, and the transformation into a temporary emulsion remains reversible, even after frequent shaking. In addition the physical form of the agent according to the invention excludes the problem of stabilization of an agent formulated as an emulsion per se. The separation of constituents into separate phases can additionally enhance the chemical stability of the agent. The agents according to the invention also have excellent residue behavior. Greasy residues are largely avoided, so that the surfaces retain their shine, without the need for rinsing.

In a preferred embodiment of the invention the continuous Phases I and II are separated from one another by a distinct interface.

In a further preferred embodiment of the invention one or both of the continuous Phases I and II contain parts, preferably 0.1–35 vol. %, especially 0.2–20 vol. %, relative to the volume of the continuous phase concerned, of the other phase as a dispersion agent. The continuous Phase I/II is therefore reduced by the fraction of the volume that is distributed through the other phase as a dispersion agent. The agents especially preferred here are those in which Phase I is emulsified in Phase II in quantities of 0.1–35 vol. %, preferably 0.2–20 vol. %, relative to the volume of Phase II.

In a further preferred embodiment of the invention besides the continuous Phases I and II, part of both phases is present as an emulsion of one of the two phases in the other phase, and this emulsion is separated from the parts of Phases I and II that are not part of the emulsion by two sharp interfaces, an upper and a lower.

The agents according to the invention contain preferably 5–95 vol. % Phase I and 95–5 vol. % Phase II.

In a further preferred embodiment of the invention the agent contains 35–95 vol. % Phase I and 5–65 vol. % Phase II, especially 55–95 vol. % Phase I and 5–45 vol. % Phase II, ideally 70–95 vol. % Phase I and 5–30 vol. % Phase II. Furthermore, the continuous Phase I preferably represents the lower phase and the continuous Phase II the upper phase.

In a likewise preferred embodiment the non-water-miscible Phase II is based on aliphatic benzine hydrocarbons and/or terpene hydrocarbons. The benzine hydrocarbons preferably have a boiling range of 130–260° C., especially 140–220° C., and ideally 150–200° C. Suitable terpene hydrocarbons are for example citrus oils, such as the orange oil obtained from orange peel, the orange terpenes contained in these, especially citron, or pine oil, which is extracted from roots and tree stumps. Phase II can also consist exclusively of aliphatic benzine hydrocarbons and/or terpene hydrocarbons, with Phase II containing benzine hydrocarbons preferably in quantities of at least 60 wt. %, especially preferably 90–100 wt. %, in particular 95–100 wt. % and ideally 99–99.99 wt. %.

As surface-active substances, tensides are suitable for the agents according to the invention, especially those from the classes of anionic and non-ionic tensides. The agents preferably contain anionic and non-ionic tensides, with the anionic tensides being contained particularly in Phase I. The quantity of anionic tenside relative to Phase I is not normally more than 10 wt. %, preferably between 0.01 and 5 wt. %, especially preferably between 0.01 and 0.5 wt. %, and ideally between 0.1 and 0.3 wt. %. To the extent that the agents contain non-ionic tensides, their concentration is preferably in Phase I, relative to Phase I, normally not more than 3 wt. %, preferably between 0.001 and 0.3 wt. % and especially between 0.001 and 0.1 wt. %, and in phase II, relative to Phase II, normally not more than 5 wt. %, preferably between 0.001 and 0.5 wt %, and especially between 0.001 and 0.2 wt. %, especially preferably between 0.005 and 0.1 wt. %, and ideally between 0.01 and 0.05 wt %.

Substances suitable as ainionic tensides are preferably $C_8$–$C_{18}$-alkylbenzene sulfonates, especially with c. 12 C atoms in the alkyl part, $C_8$–$C_{20}$-alkane sulfonates, $C_8$–$C_{18}$-monoalkylsulfates, $C_8$–$C_{18}$-alkylpolyglycolethersulfates with 2–6 ethylene oxide units (EO) in the ether part and sulfosuccinic acid esters with 8–18 C atoms in the alcohol residues.

The anionic tensides are preferably used as sodium salts, but can also be contained as other alkali- or alkaline-earth metallic salts, for example magnesium salts, and in the form of ammonium or amine salts.

Examples of such tensides include sodium-coconut-alkylsulfate, sodium-sec.-alkane sulfonate with c. 15 C atoms and sodium dioctylsulfosuccinate. Fat alkylsulfates with 12–14 C atoms and also sodium laurylethersulfate with 2 EO have proved especially suitable.

As non-ionic tensides, the following substances should especially be mentioned: $C_8$–$C_{18}$-alcoholpolyglycolethers, i.e. ethoxylated alcohols with 8–18 C atoms in the alkyl part and 2–15 ethylene oxide units (EO), $C_8$–$C_{18}$-carbonic acid polyglycolesters with 2–15 EO, ethoxylated fatty acid amides with 12–18 C atoms in the fatty acid part and 2–8 EO, long-chained amine oxides with 14–20 C atoms and long-chained alkylpolyglycosides with 8–14 C atoms in the alkyl part and 1–3 glycoside units. Examples of such tensides are oleyl-cetyl-alcohol with 5 EO, nonylphenol with 10 EO, laurinic acid diethanolamide, coconut-alkyldimethylamine oxide and coconut-alkylpolyglucoside with, on average, 1.4 glucose units.

As non-ionic tensides in the aqueous phase, in addition to the additive products of ethylene oxide and fat alcohols, with,in particular, 4–8 ethylene oxide units, the alkylpolyglycosides are preferred, and of these the representatives with 8–10 C atoms in the alkyl part and up to 2 glucose units. In the non-aqueous Phase II, substances especially preferred as non-ionic tensides are fat alcohol polyglycolethers, especially with 2–8 EO, for example oleyl-cetyl-alcohol+5-EO-ethers, and/or fatty acid polyglycolester (FAE) especially with 2–10 EO, for example tallow fatty acid+6-EO-esters. Also for the non-ionic tensides, in particular the alcohol-polyglycolethers and carbonic acid polyglycolesters, for Phase II the degree of ethoxylation is determined on the basis of the C-chain length, so that shorter C chains are combined with lower degrees of ethoxylation and/or longer C chains are combined with higher degrees of ethoxylation.

Agents that contain anionic and non-ionic tenside are especially preferred, with combinations of anionic tenside in Phase I and non-ionic tenside in Phase II being especially advantageous, for example combinations of fat alkylsulfates and/or fat alcohol polyglycolethersulfates in Phase I with fat alcohol polyglycol ethers and/or FAE [fatty acid polyglycolesters] in Phase II.

Furthermore the detergents according to the invention can contain water-soluble organic solvents in the form of low alcohols and/or ether alcohols, but preferably mixtures of alcohols and ether alcohols. The quantity of organic solution preferably amounts to 0.1–15 wt. %, especially 1–10 wt. %, relative to the aqueous Phase I.

Ethanol, isopropanol and n-propanol are especially used as alcohols. Sufficiently water-soluble compounds with up to 10 C atoms in the molecule are considered as ether alcohols. Examples of such ether alcohols are ethylene glycol monobutylethers, propylene glycolmonobutylethers, diethylene glycolmonobutylethers, propylene glycolmonotertiary butylethers and propylene glycol monoethylethers, of which, in turn, ethylene glycolmonobutyl ethers and propylene glycolmonobutyl ethers are preferred. If alcohol and ether alcohol are used together, the weight ratio of the two is preferably between 1:2 and 4:1. Ethanol is especially preferred within the framework of the invention.

The agents can be transformed into the temporary emulsion according to the invention by shaking, preferably up to three times, especially up to twice, and ideally once. The temporary emulsion generated by shaking is stable for a period sufficient for convenient application of the agent, of c. 0.5–10 min, preferably 1–5 min, and especially 1.5–3 min, i.e. on the one hand it does not break down again immediately after shaking has ceased, and on the other hand it does not continue to exist over a long period. The term stable here means that after the period in question, at least 90 vol. % of the agent is still present as the temporary emulsion generated by shaking. Besides the selection and dosage of basic and active constituents, there is a regulator to adjust the latter properties of the agents according to the invention in controlling the viscosity of the individual phases.

The aqueous Phase I preferably has a viscosity according to Brookfield (model DV-II+, spindle 31, rotational frequency 20 $min^{-1}$, 20° C.) of 0.1–200 mPa·s, especially 0.5–100 mPa·s, and ideally 1–60 mPa·s. For this purpose the agent and/or the phases contained in it can contain viscosity regulators. The quantity of viscosity regulator in Phase I, relative to Phase I, usually amounts to up to 0.5 wt. %, preferably 0.001–0.3 wt. %, especially 0.01–0.2 wt. %, and ideally 0.05–0.15 wt. %. Suitable viscosity regulators include synthetic polymers such as the homo and/or co-polymers of acrylic acid or its derivatives, for example the products obtainable from the company Goodrich, under the trade name Carbopol®, especially the cross-linked acrylic acid copolymer Carbopol-ETD-2623®. The international application WO 97/38076 lists a number of further polymers derived from the acrylic acid, which also represent suitable viscosity regulators.

Furthermore, the agents according to the invention can contain volatile alkali in Phase I. As such, ammonia and/or alkanolamines which can contain up to 9 C atoms in the molecule are used. As alkanolamines, the ethanolamines are preferred, and of these, in turn, the monoethanolamine. The content of ammonia and/or alkanolamines, relative to Phase I, preferably amounts to 0.01–3 wt. %, especially 0.02–1 wt. %, and ideally 0.05–0.5 wt. %.

Besides the volatile alkali the agents according to the invention can also contain carboxylic acid in Phase I, with the equivalent ratio of amine and/or ammonia to carboxylic acid preferably between 1:0.9 and 1:0.1. Carboxylic acids with up to 6 C atoms are suitable, and these may be mono, di or polycarboxylic acids. Depending on the equivalent weight of amine and carboxylic acid, the content of carboxylic acid relative to Phase I, lies preferably between 0.01 and 2.7 wt. %, especially between 0.01 and 0.9 wt %. Examples of suitable carboxylic acids are acetic acid, glycolic acid, lactic acid, citric acid, succinic acid and adipic acid, of which acetic acid, citric acid and lactic acid are preferably used. Use of acetic acid is especially preferred.

Besides the above-mentioned components, the agents according to the invention can contain further auxiliary agents and admixed materials such as are usual in agents of this kind. These include in particular dyes, perfume oils, pH regulators (e.g. citric acid, alkanolamines or NaOH), preservatives, chelating agents for alkaline-earth ions, enzymes, bleaching systems, and antistatic substances. The quantity of such additives does not usually exceed 2 wt. % of the detergent. The lower limit of the additive depends on the type of the additive and can for example, in the case of dyes, amount to up to 0.001 wt. % and below. The quantity of auxiliary agents preferably lies between 0.01 and 1 wt. %.

The pH value of the aqueous Phase I can be varied across a wide range, but a range of 2.5–12 is preferred, preferably 5–10.5, especially 7–10.

In a preferred embodiment the agents according to the invention contain:

70–95 vol. % aqueous Phase I, containing
0.01–10 wt. % anionic tenside,
0–3 wt. % non-ionic tenside,
0–10 wt. % water-soluble organic solvent,
0–0.5 wt. % viscosity regulator
0–3 wt. % volatile alkali,
0–0.2 wt. % perfume and
ad 100 wt. % water and
5–30 vol. % non-aqueous Phase II, containing
0–99.999 wt. % aliphatic benzine hydrocarbons,
0–99.999 wt. % terpene hydrocarbons,
0.001–5 wt. % non-ionic tenside and
0–1 wt. % perfume, with the wt. % figures relating to the Phase in question, the total of the benzine and terpene hydrocarbons in Phase II are completed ad 100 wt. % and the phases can additionally contain small quantities of dye.

Utilization of the agents according to the invention is carried out in that the agent, temporarily transformed into an emulsion by shaking, is applied in quantities of, for example, c. 1.5–10 g per $m^2$, preferably 3–7 g per $m^2$, to the surface to the cleaned, and this surface is then immediately wiped with a soft, absorbent object, and thus cleaned. The application of the agent is preferably carried out by means of suitable spraying devices, to achieve the most even distribution possible. Sponges or cloths are particularly suitable for wiping, said sponges and cloths being rinsed out with water from time to time, when treating fairly large surfaces.

The agents according to the invention are produced by separate mixing of the individual phases directly from their respective raw materials, then putting the phases together and intermixing them, and finally leaving the mixture to stand until the temporary emulsion separates. They can also be produced by directly mixing up their raw materials, then intermixing and finally leaving the mixture to stand until the temporary emulsion separates. If a component is not completely insoluble in a phase other than that to which the component is assigned, or with which it is introduced into the agent, this other phase may also contain corresponding constituents of the component concerned within the framework of adjustment of solubility equilibrium by diffusion.

EXAMPLES

The following recipes were processed as described above to produce the agents E1 to E5 according to the invention. The constituents given in brackets are examples of the substance class in each case, but can be replaced by other substances listed in the application. The basic recipe represents a preferred range of the invention.

The following components were used in Phase I:

a) anionic tensides ([1] Sodium-$C_{12-14}$-fat alkylsulphate, [2] Sodium-$C_{12-14}$-fat alkyl-2EO-sulphate), b) non-ionic tensides, c) water-soluble solvent (ethanol), d) emulsifier (Carbopol 2643)

e) alkali (aqueous ammonia solution, 25 wt. %)

f) perfume and g) water, and in

Phase II h) aliphatic benzine hydrocarbons (benzine hydrocarbons with boiling range of 162–192° C.), i) terpene hydrocarbons (orange terpenes), j) non-ionic tensides ([3] tallow fatty acid+6EO, [4] oleylcetylalcohol+5EO (with c. 30 wt. % $C_{16}$ and c. 70 wt. % $C_{18}$ constituents)) and k) perfume as well as small quantities of dye in Phase I and/or Phase II. The test recipes contained neither perfume nor dye in Phase II.

The composition of the basic recipe R and the recipes E1 to E5 according to the invention (constituents of Phases I and II in vol. %, quantities of the components a)–i) in wt. %) and the pH value and the viscosity, determined as described, of the aqueous Phase I of the agents E1 to E5 are shown in Table 1.

TABLE 1

| | R | E1 | E2 | E3 | E4 | E5 |
|---|---|---|---|---|---|---|
| I | 70–95 | 85 | 85 | 85 | 75 | 85 |
| a) | 0.01–10 | 0.2[1] | 0.2[1] | 0.18[2] | 0.2[1] | 0.15[1] |
| b) | 0–3 | — | — | 0.02 | — | — |
| c) | 0–10 | 5 | 7 | 5 | 5 | 3 |
| d) | 0.05 | — | — | — | — | 0.08 |
| e) | 0–3 | — | — | — | — | 0.3 |
| f) | 0–0.2 | 0.08 | 0.08 | 0.08 | 0.08 | 0.08 |
| g) | ad 100 | ad 100 | ad 100 | ad 100 | ad 100 | ad 100 |
| II | 5–30 | 15 | 15 | 15 | 25 | 15 |
| h) | 0–99.999 | 99.98 | 69.98 | 99.97 | 99.97 | 99.98 |
| i) | 0–99.999 | — | 30 | — | — | — |
| j) | 0.001–5 | 0.02[3] | 0.02[3] | 0.03[4] | 0.03[4] | 0.02[3] |
| k) | 0–1 | — | — | — | — | — |
| pH | — | 8.4 | 8.4 | 8.4 | 8.4 | 8.2 |
| viscosity [mPa · s] | — | 3 | 3 | 3 | 3 | 28 |

The recipes according to the invention had a clear lower Phase I and an upper Phase II, which was slightly milky and cloudy because of a small quantity of emulsified Phase I.

Testing of Cleaning Effect

To test the cleaning effect under extreme conditions the following method was used:

White PVC strips (40 mm×554 mm) were soiled with test dirt and, following standardized treatment in the Gardener test equipment, their light remission was measured. The test dirt consisted of:

7 wt. % fine-particled soot, 57 wt. % Myritol® (fatty acid triglyceride) and 36 wt. % test benzine.

Said dirt was applied evenly in quantities of 0.3 g per strip. After 1–1.5 hours drying time, the strips, several of which had been soiled simultaneously, were used for the test. The cleaning procedure consisted of 20 wiping movements carried out by mechanical wiping with a polyester sponge under a standardized load (800 g), with 6 g detergent being used. After rinsing under running water the light remission was measured in comparison with the untreated strip. The results of these tests are shown in Table 2 as relative cleaning efficiency in % in comparison with a market-leading single-phase standard glass cleaner established as 100%.

TABLE 2

| | E1 | E2 | E3 | E4 | E5 |
|---|---|---|---|---|---|
| Cleaning efficiency [%] | 122 | 118 | 112 | 120 | 114 |

From the results, it is clear that agents according to the invention compared with conventional single-phase agents show at least equivalent cleaning efficiency or even exceed these in their cleaning efficiency, as in the case of the examples according to the invention.

What is claimed is:

1. A liquid, multiphase, essentially CRC-free cleaning composition comprising at least two continous phases, comprising at least one aqueous liquid Phase I and a non-aqueous liquid Phase II which is immiscible with the aqueous phase wherein the cleaning composition can, by shaking, be temporarily transformed into an emulsion, and wherein the cleaning composition contains at least one member selected from the group consisting of anionic tensides and nonionic tensides, and a foaming water soluble, organic tenside content, relative to the aqueous Phase I is not more than 10% by weight, and the non-aqueous liquid phase II comprises a member selected from the group consisting of aliphatic hydrocarbons having boiling point in a range of 130° C. to 260° C., terpene hydrocarbons, and mixtures thereof.

2. The cleaning composition according to claim 1, wherein the continuous Phases I and II are separated from each other by a distinct interface.

3. The cleaning composition according to claim 1 wherein at least one of the continuous phases I and II contains from 0.1–35 vol. % relative to the volume of the continuous phase of the other phase.

4. The cleaning composition according to claim 3 wherein Phase I is emulsified in quantities of 0.1–35 vol. %, relative to the volume of Phase II, in Phase II.

5. The cleaning composition according to claim 1 wherein in addition to the continous phases I and II, a part of both phases is present as an emulsion of one of the two phases in the other phase, and this emulsion is separated by two distinct interfaces, an upper and a lower interface, from the parts of Phases I and II which are not part of the emulsion.

6. The cleaning composition according to claim 1 comprising 35–95 vol. % Phase I, and 5–65 vol. % Phase II.

7. The cleaning composition according to claim 1 comprising a Phase II based on a member selected from the group consisting of aliphatic benzine hydrocarbons, with a boiling range of 140° C.–220° C., terpene hydrocarbons and mixtures thereof.

8. The cleaning composition according to claim 1 comprising in Phase II, aliphatic benzine hydrocarbons, with a boiling range of 140–220° C., in an amount relative to Phase II, of 60–100 wt. %.

9. The cleaning composition according to claim 1 comprising an anionic tenside selected from the group consisting of $C_8$–$C_{18}$-alkylbenzene sulfonates, $C_8$–$C_{20}$-alkane sulfonates, $C_8$–$C_{18}$-monoalkyl sulfates, $C_8$–$C_{18}$-alkylpolyglycolether sulfates with 2–6 ethylene oxide units, $C_8$–$C_{18}$-alkyl alcohol sulfosuccinic acid esters and mixtures thereof.

10. The cleaning composition according to claim 1 comprising a non-ionic tenside selected from the group consisting of the ethoxylates of long-chain alcohols, alkylpolyglycosides and mixtures thereof in at least one of Phase I and Phase II.

11. The cleaning composition according to claim 1 comprising anionic and nonionic tensides.

12. The cleaning composition according to claim 11 comprising, in Phase I, an anionic tenside, selected from the group consisting of $C_{12-14}$ fatty alcohol sulfates, $C_{12-14}$ fatty alcohol polyglycolether sulfates, and, in Phase II, a nonionic tenside, selected from the group consisting of $C_{16-18}$ fatty alcohol polyglycol ethers $C_{14-18}$ fatty acid polyglycol esters and mixtures thereof.

13. The cleaning composition according to claim 1 comprising a water-soluble organic solvent selected from the group consisting of alcohols with 2 to 3 C atoms, glycol ethers, ethylene glycolmonobutyl ethers, propylene glycol monobutyl ethers and mixtures thereof.

14. The cleaning composition according to claim 13, comprising in Phase I, relative to Phase I, 0.1–15 wt. %, of water-soluble organic solvent.

15. The cleaning composition according to claim 1 comprising in Phase I viscosity regulators, in quantities relative to Phase I, of up to 0.5 wt. %.

16. The cleaning composition according to claim 15, wherein Phase I has a viscosity of 0.1–200 mPa·s.

17. The cleaning composition according to claim 1 wherein Phase I comprises volatile alkali, in amounts relative to Phase I, of 0.01–3 wt. %.

18. The cleaning composition according to claim 1 comprising:

70–95 vol. % aqueous Phase I, containing a) 0.01–10 wt. % anionic tenside,
b) 0–3 wt. % nonionic tenside,
c) 0–10 wt. % water-soluble organic solvent,
d) 0–0.5 wt. % viscosity regulator,
e) 0–3 wt. % volatile alklali,
f) 0–0.2 wt. % perfume and
g) add 100 wt. % water and
h) 5–30 vol. % non-aqueous Phase II, containing
i) 0–99.999 wt. % aliphatic hydrocarbons having a boiling point in a range of 130° C.–260° C.
j) 0–99.999 wt. % terpene hydrocarbons,
k) 0.001–5 wt. nonionic tenside and
l) 0–1 wt. perfume, with the wt. % figures relating to the Phase, the total of the components h and i in Phase II being completed ad 100 wt. % and the phases optionally containing small quantities of dye.

19. The cleaning composition according to claim 18, comprising the anionic tensides a) in quantities of 0.01–5 wt. % and the nonionic tensides j) in quantities of 0.001–0.5 wt. %.

20. A method for cleaning hard surfaces, in which a detergent according to claim 1 is temporarily transformed into an emulsion by shaking, applied to the surface to be cleaned in an amount of 1.5–10 g per $m^2$, and the surface is cleaned.

* * * * *

UNITED STATES PATENT AND TRADEMARK OFFICE

CERTIFICATE OF CORRECTION

PATENT NO. : 6,521,584 B1
DATED : February 18, 2003
INVENTOR(S) : Heinz-Dieter Soldanski et al.

It is certified that error appears in the above-identified patent and that said Letters Patent is hereby corrected as shown below:

Title page,
Item [73], Assignee, delete "Dusesseldorf" and insert therefore -- Duesseldorf --.
Item [57], ABSTRACT,
Line 7, delete "surfactant" and insert -- tenside --.

Column 8,
Line 20, delete "CRC" and insert -- CFC -- and
Line 21, delete "continous" and insert -- continuous --.
Line 31, after "having" and before "boiling", insert -- a --.

Column 10,
Line 18, delete "ad", and insert -- add --.

Signed and Sealed this

Twenty-sixth Day of July, 2005

JON W. DUDAS
*Director of the United States Patent and Trademark Office*